US009070975B2

(12) United States Patent
Collins et al.

(10) Patent No.: US 9,070,975 B2
(45) Date of Patent: Jun. 30, 2015

(54) ANTENNAS WITH MULTIPLE FEED CIRCUITS

(75) Inventors: Brian Collins, Stow-cum-Quy (GB); Marc Harper, Stow-cum-Quy (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 497 days.

(21) Appl. No.: 13/388,126

(22) PCT Filed: Aug. 12, 2010

(86) PCT No.: PCT/GB2010/051335
§ 371 (c)(1),
(2), (4) Date: Jan. 31, 2012

(87) PCT Pub. No.: WO2011/021027
PCT Pub. Date: Feb. 24, 2011

(65) Prior Publication Data

US 2012/0133571 A1 May 31, 2012

(51) Int. Cl.
*H01Q 1/50* (2006.01)
*H01Q 1/24* (2006.01)
(Continued)

(52) U.S. Cl.
CPC ..... *H01Q 1/242* (2013.01); *H01Q 7/00* (2013.01); *H01Q 9/145* (2013.01)

(58) Field of Classification Search
CPC ..... H01Q 7/00; H01Q 9/145; H01Q 1/242
See application file for complete search history.

(56) References Cited

U.S. PATENT DOCUMENTS 6,429,821 B1 * 8/2002 Lewis, Jr. ..... 343/749
7,469,131 B2 * 12/2008 Nail et al. ..... 455/168.1
(Continued)

FOREIGN PATENT DOCUMENTS

EP 1 870 957 A1 12/2007
JP 2006 086630 3/2006
(Continued)

OTHER PUBLICATIONS

International Search Report and Written Opinion issued for International Application No. PCT/GB2010/051335 and dated Apr. 12, 2011.
(Continued)

*Primary Examiner* — Trinh Dinh
(74) *Attorney, Agent, or Firm* — Ladislav Kusnyer; Judy Yee; Mickey Minhas

(57) ABSTRACT

There is disclosed an antenna arrangement comprising an electrically conductive radiating element having first and second ends, an electrically conductive ground plane or ground member, and an input terminal. The radiating element has a plurality of separate feed points at different locations between its first and second ends, and the input terminal is provided with a switch. Each feed point is electrically connected to the switch by way of a separate electrical pathway, the switch being configured to allow the separate feed points to be connected individually or in predetermined combinations to the input terminal by selecting between a plurality of selectable contacts. At least one of the electrical pathways includes a capacitive circuit component connected in series, and at least one other of the electrical pathways includes an inductive circuit component connected in series. The antenna arrangement allows for a high degree of customization and improved matching, and enables good multi-band performance.

11 Claims, 7 Drawing Sheets

(51) Int. Cl.
*H01Q 7/00* (2006.01)
*H01Q 9/14* (2006.01)

(56) References Cited

U.S. PATENT DOCUMENTS

| | | | | |
|---|---|---|---|---|
| 7,542,005 | B2 * | 6/2009 | Mohamadi | 343/853 |
| 7,864,127 | B2 * | 1/2011 | Parsche | 343/773 |
| 8,121,544 | B2 * | 2/2012 | Shimizu et al. | 455/41.1 |
| 8,144,071 | B2 * | 3/2012 | Thornell-Pers | 343/860 |
| 8,629,813 | B2 * | 1/2014 | Milosavljevic | 343/852 |
| 2007/0290934 | A1 * | 12/2007 | Nakamura et al. | 343/702 |
| 2008/0055164 | A1 | 3/2008 | Zhang et al. | |
| 2009/0251382 | A1 * | 10/2009 | Umehara | 343/850 |

FOREIGN PATENT DOCUMENTS

| | | |
|---|---|---|
| WO | WO 2005/112280 | 11/2005 |
| WO | WO 2007/147940 | 12/2007 |
| WO | WO 2009/027579 | 3/2009 |

OTHER PUBLICATIONS

"Office Action Received in China Application No. 201080035985.1", Mailed Date: Sep. 3, 2013, Filed Date: Aug. 12, 2010, 8 Pages. (w/o English Translation).

"Office Action Received in China Application No. 201080035985.1", Mailed Date: Mar. 4, 2014, Filed Date: Aug. 12, 2010, 3 Pages. (w/o English Translation).

* cited by examiner

Measured return loss at input port for 698-798MHz band

Measured return loss, 824-2170MHz

ANTENNAS WITH MULTIPLE FEED CIRCUITS

CROSS-REFERENCE TO RELATED APPLICATIONS

This application is a National Phase Application of PCT International Application No. PCT/GB2010/051335, International Filing Date 12 Aug., 2010, claiming priority of UK Patent Application GB 0914280.3, filed 17 Aug. 2009, which are hereby incorporated by reference in their entirety.

FIELD OF THE INVENTION

This invention relates to antennas having multiple feed circuits allowing additional circuit elements to be added thereby to improve multiband operation

BACKGROUND

The growth of mobile radio applications has led to the development of services using a variety of different air interface standards and radio frequency bands in different parts of the world. A current generation mobile phone is likely to provide for transmissions using the GSM or UMTS air interfaces (as defined by the international standards body 3GPP) on the 850 MHz, 900 MHz, 1800 MHz, 1900 MHz and 2100 MHz frequency bands. The development of compact antennas capable of operating on all these bands, for use in mobile handsets, laptop computers, trackers and other user equipment (UE) is very challenging. The development of antenna techniques has in general been evolutionary, simple dual band structures being progressively optimized to provide wider operating bandwidths at each of the two frequency bands. Current 'pentaband' antennas operate over the frequency bands 826-960 MHz and 1710-2170 MHz.

The economics of handset design and production, as well as users' requirements for world-wide roaming, imply that a handset is required to operate on all the standard frequency bands associated with the interface protocol(s) which it supports.

The advent of new mobile services in the frequency band 698-798 MHz, when combined with existing requirements in the band 826-960 MHz creates a new challenge to the antenna designer. The present invention provides a means by which this requirement may be satisfied without any significant increase in the volume occupied by the antenna.

With reference to FIG. 1, it is well known that a single radiating element 10 may be fed concurrently with radio signals at two frequencies, f1 and f2 by the means shown in FIG. 1, where 11 is a band-stop filter tuned to f2, 12 is a band-stop filter tuned to f1, 13 is an input matching circuit adjusted to provide the required matched input impedance at f1 and 14 is an input matching circuit adjusted to provide the required matched input impedance at f2. Such an arrangement works well if the bandwidths of the signals at f1 and f2 are small compared with their frequency separation (f1-f2). If the frequency separation is small or the bandwidth is large, then the design of suitable filters and matching circuits becomes difficult—their cost, dimensions and associated transmission losses become unacceptably large.

Alternative arrangements providing for optional transmission at f1 or f2 may be designed as shown in FIG. 2 by making use of a switch 15 at the antenna input and two alternative matching circuits, one for f1 [13] and the other for f2 [14]. Such an arrangement is satisfactory in many circumstances, but presupposes that the antenna may be matched effectively and economically for both frequency bands f1 and f2 when the feed point to the antenna is at one fixed location.

In the case of mobile radio antennas, the large width of the frequency bands in which f1 and f2 may be positioned, the small fractional separation between the adjacent ends of these frequency bands, and the necessarily small physical dimensions of the antenna (typically 0.2×0.06×0.025 wavelengths) result in an input impedance which is very difficult to match effectively over the specified bands. The result of inadequate impedance matching is reduced antenna efficiency with consequential reduced range, data rate and battery life.

BRIEF SUMMARY OF THE DISCLOSURE

According to a first aspect of the present invention, there is provided an antenna arrangement comprising an electrically conductive radiating element having first and second ends, an electrically conductive groundplane or ground member, and an input terminal; wherein the radiating element has a plurality of separate feed points at different locations between its first and second ends, wherein the input terminal is provided with a switch, and wherein each feed point is electrically connected to the switch by way of a separate electrical pathway, the switch being configured to allow the separate feed points to be connected individually or in predetermined combinations to the input terminal by selecting between a plurality of selectable contacts, and wherein at least one of the electrical pathways includes a capacitive circuit component connected in series and wherein at least one other of the electrical pathways includes an inductive circuit component connected in series.

For example, where two feed points are provided, spaced from each other along the radiating element, there will be two electrical pathways connecting the switch to the radiating element, one for each feed point, and the switch will be configured to allow one or other of the two electrical pathways to be connected to the input terminal. One of the pathways will include a capacitive circuit component connected in series between the input terminal/switch and the feed point associated with that pathway, while the other pathway will include an inductive circuit component connected in series between the input terminal/switch and the feed point associated with the other pathway. Where three feed points are provided, there will be three electrical pathways and the switch will be operable selectively to connect any one of the three electrical pathways to the input terminal. Any number of feed points and associated pathways and selectable contacts may be provided for particular applications, provided that the number is always two or more, and provided that at least one pathway includes a capacitive circuit component and at least one other pathway includes an inductive circuit component.

It has been found that a spacing between the feed points along the radiating element is an important parameter, and must be carefully selected in order to achieve good antenna operation. The feed impedance changes as a function of position along the radiating element. The choice of feed position therefore depends on the configuration of the radiating element and the frequencies that are of interest.

In simpler embodiments, each feed point and associated pathway is individually switched in by the switch—that is to say, when one feed point and pathway is switched in, all of the others are switched out. However, in more complex embodiments, two or more feed points and associated pathways may be connected at the same time to the input terminal. This provides additional degrees of freedom and to provide a wider bandwidth in some applications.

Each pathway and feed point may be associated with a predetermined frequency band.

In some embodiments, the radiating element, or at least one end thereof, is electrically connected to the groundplane or ground member, either directly (galvanically) or through an inductive and/or capacitive circuit component. This provides an additional degree of freedom which can help match the antenna in particular circumstances.

In some embodiments, resistive, inductive and/or capacitive circuit components may be placed in series with the radiating element between the feed points. Where there are three or more feed points, different circuit components may be placed in series between different pairs of feed points, or circuit components may be placed between some pairs of feed points and not others. For example, where there is a large difference between two required operating frequency bands, it has been found that placing an inductor in series with the radiating element, between two feed points, can facilitate matching at both bands.

In a further embodiment of the invention, matching networks comprising inductive and/or capacitive circuit elements may optionally be connected in series with the feeding pathways. Such tuning elements may optionally contain circuit elements connected to ground, but any impedance to ground will cause a change in the impedances presented at all feed points and not only the feed point at which the element is positioned; by contrast, circuit elements connected in series will change the input impedance at the associated switch input terminal while having little effect on the impedance presented at other input terminals.

It will be appreciated that in any single embodiment the inductive, capacitive and/or circuit elements may each be optionally provided or omitted, the place of omitted elements being taken by a direct connection (a nominal impedance of 0+j0 ohms), provided always that there is one feed point connected to the input terminal/switch by way of a pathway with an inductive circuit component connected in series, and another feed point connected to the input terminal/switch by way of a pathway with a capacitive circuit component connected in series.

In a particularly preferred embodiment, the radiating element takes the form of a loop antenna comprising a dielectric substrate having first and second opposed surfaces and a conductive track formed on the substrate, wherein there is provided a first feed point, a second feed point and a grounding point on the first surface of the substrate, with the conductive track extending from the first feed point and the grounding point respectively, then extending towards an edge of the dielectric substrate, then passing to the second surface of the dielectric substrate and then passing across the second surface of the dielectric substrate along a path generally following the path taken on the first surface of the dielectric substrate, before connecting at a conductive loading plate formed on the second surface of the dielectric substrate that extends into a central part of a loop formed by the conductive track on the second surface of the dielectric substrate.

The first feed point is configured as an inductive feed, for example an inductively-coupled loop or a galvanic tap connection, and the second feed point is configured as a capacitive feed.

It will be appreciated that while the foregoing is framed in terms of the antenna arrangement acting as a transmitter, the discussion applies equally to the antenna arrangement when operating in receiver mode. Indeed, all antennas generally work both to transmit and to receive Radio Frequency (RF) signals, one being the reciprocal equivalent of the other, and it is standard practice when describing antennas to do so in terms of their transmitting characteristics, the receiving characteristics being implied and derivable from the transmitting characteristics. Accordingly, embodiments of the present invention apply both to transmitting as well as receiving configurations.

BRIEF DESCRIPTION OF THE DRAWINGS

For a better understanding of the present invention and to show how it may be carried into effect, reference shall now be made by way of example to the accompanying drawings, in which.

DETAILED DESCRIPTION

Figure 1:
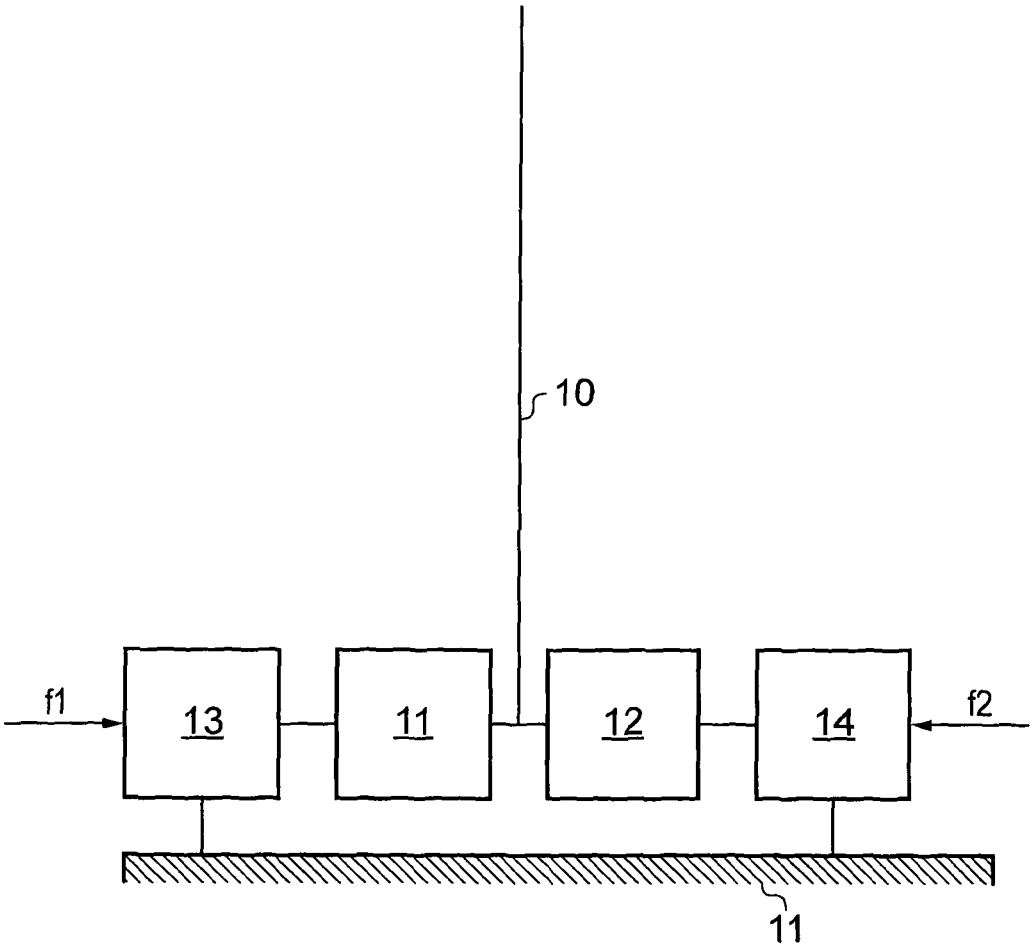
FIG. 1 (Prior Art)
FIG. 1 shows a prior art antenna arrangement in which a single radiating element is fed with two signals at different frequencies.
Figure 2:
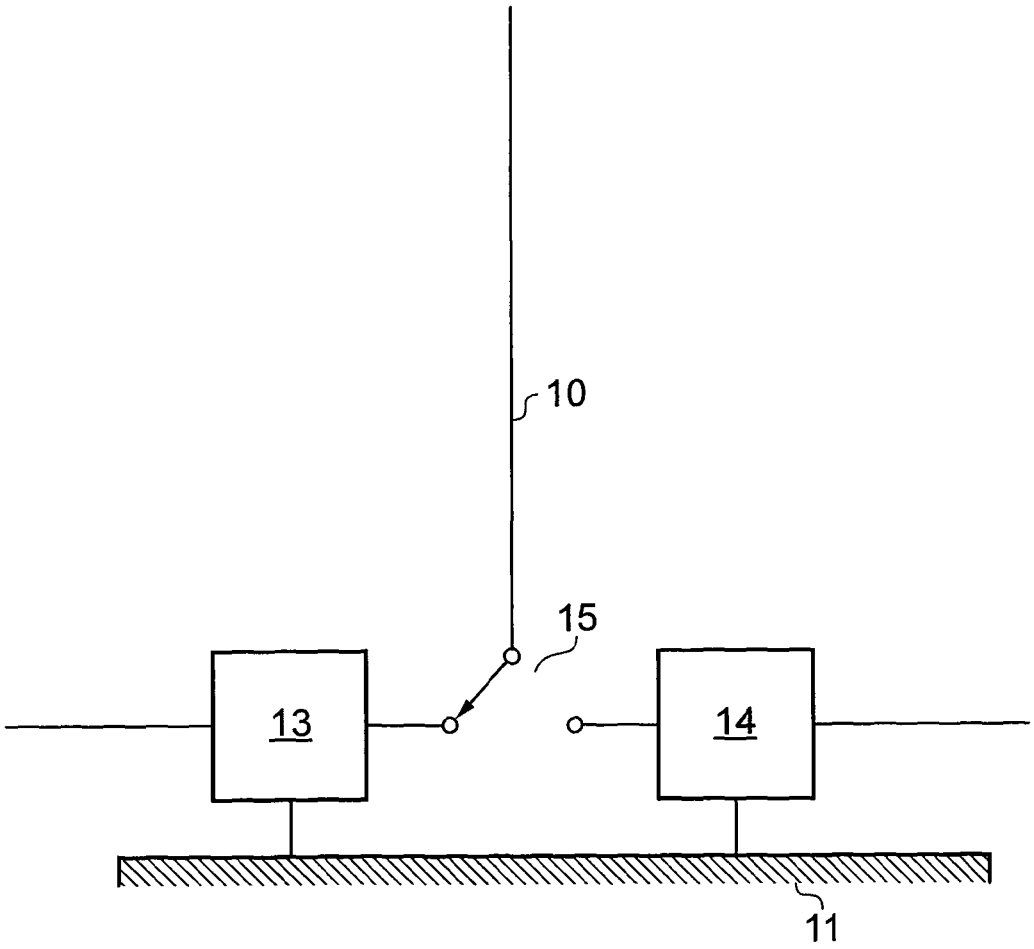
FIG. 2 (Prior Art)
FIG. 2 shows an alternative prior art antenna arrangement in which a single radiating element is fed with two signals at different frequencies.
Figure 3:
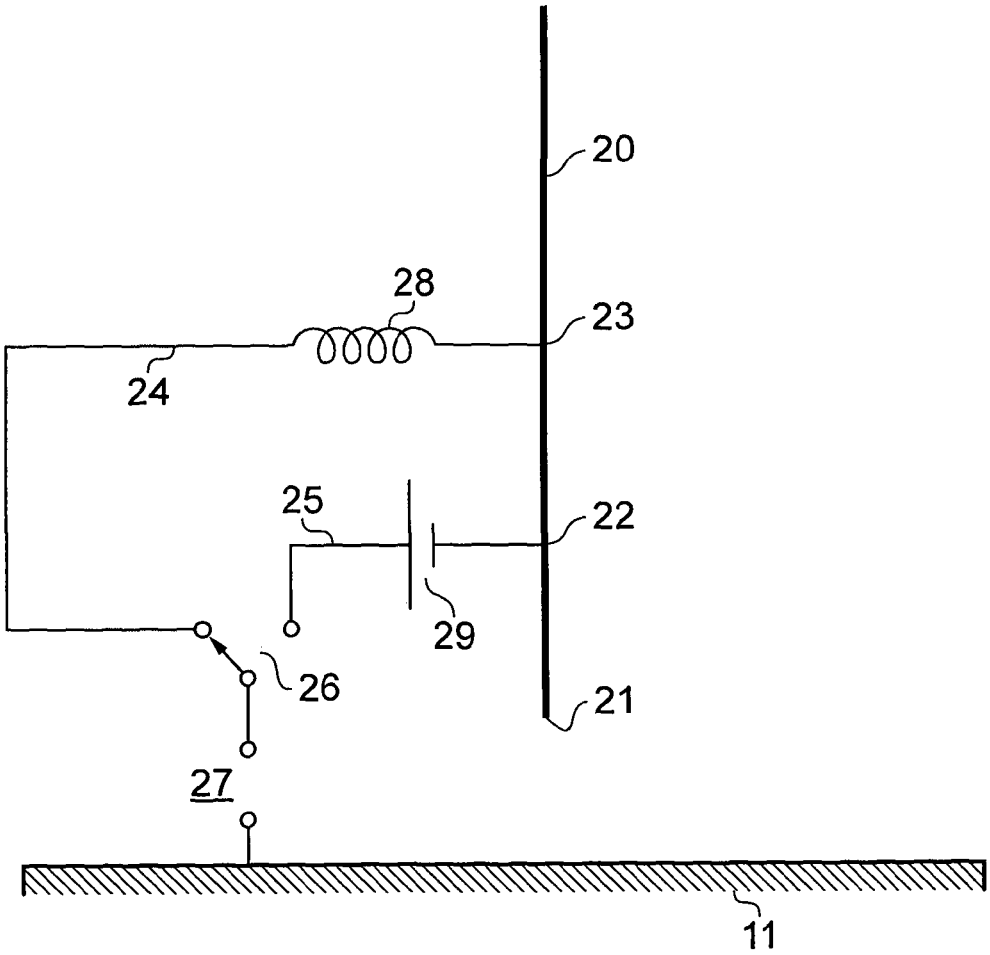
FIG. 3 shows in schematic form a first embodiment of the present invention, in which an antenna radiating element is fed at two separate feed points.

An improved arrangement is shown in its simplest form in FIG. 3 in which there is provided a conductive antenna member 20 acting in conjunction with a grounded member 11. The end 21 of the conductive antenna member 20 may optionally be connected to the grounded member 11. At least two separate feed points 22, 23 are provided on the antenna member and are connected by a corresponding number of conductors 24, 25 respectively to the input terminal 27 by means of an input switch 26 having the same number of selectable contacts as the number of feed points and connecting conductors which allows the selection of the feed system associated with each frequency band.

A capacitive circuit component 29 is connected in series in the pathway defined by the conductor 25, and an inductive circuit component 28 is connected in series in the pathway defined by the conductor 24.

Figure 4:
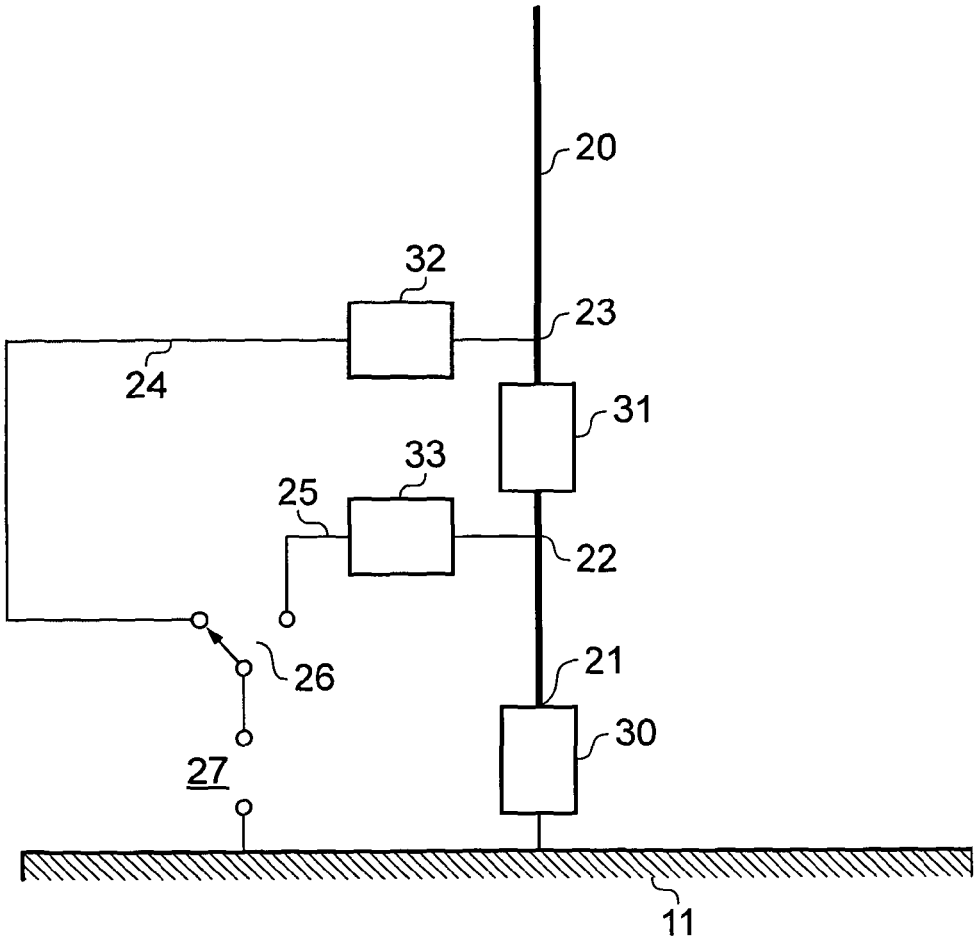
FIG. 4 shows in schematic form a second embodiment of the present invention, in which additional capacitive and/or inductive components are incorporated.

In a further embodiment the end 21 of the antenna conductive member 20 is connected to the groundplane 11 directly or through an inductive or capacitive circuit element 30 (as shown, for example, in FIG. 4).

Advantageously, as shown in FIG. 4, capacitive, inductive or resistive circuit elements are optionally placed in series with the antenna member between the feed points 22, 23.

In a further embodiment of the invention, matching networks comprising inductive or capacitive circuit elements are optionally connected in series with the feeding conductors. Such tuning elements may optionally contain circuit elements connected to ground, but any impedance to ground will cause a change in the impedances presented at all feed points and not only the feed point at which the element is positioned; by contrast, circuit element connected in series will change the input impedance at the associated switch input terminal while having little effect on the impedance presented at other input terminals.

Figure 6:
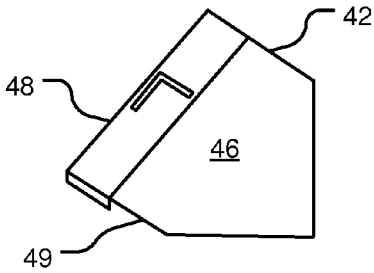
FIG. 6 (RELATED ART)
FIGS. 5 and 6 show a practical embodiment the present invention utilizing a folded loop antenna.
Figure 5:
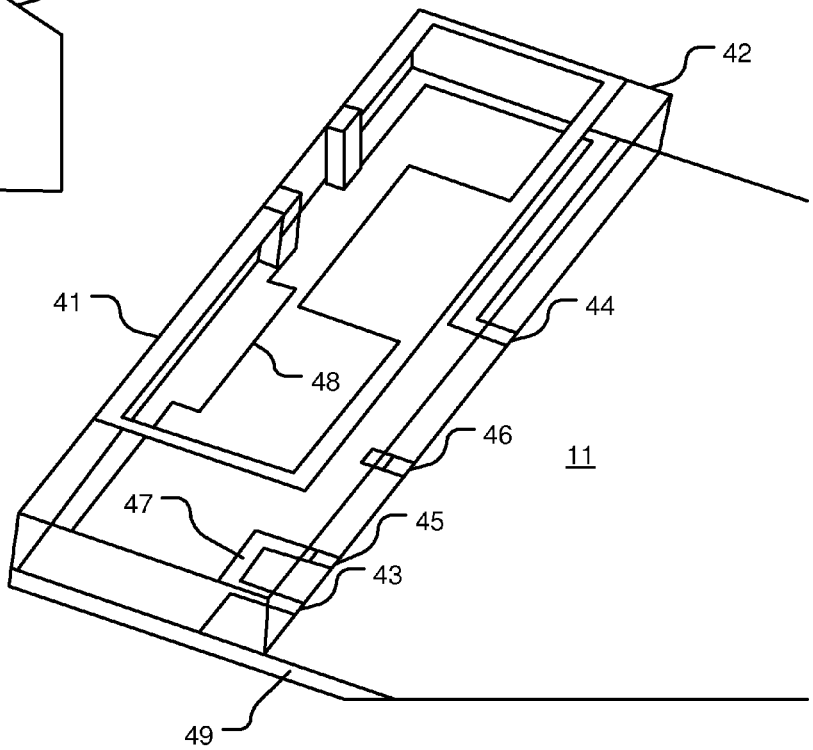
FIG. 5 (RELATED ART)

In a preferred embodiment the conductive radiating element is formed into a folded loop as described in UK patent application no 0912368.8 filed on 28 Jul. 2009 and illustrated in FIGS. 5 and 6. Here a laminar dielectric member 49 supports a laminar ground conductor 11 and a dielectric antenna support 42. The ends 43, 44 of the conductive radiating member 41 terminate on the ground conductor 11. In this exemplary embodiment two input connections 45, 46 are provided. The connection at 45 is a galvanic connection made through a small coupling loop 45-47-43, which may alternatively be described as a tap on the input connection of the loop 41. The current in the loop 45-43-47 creates a magnetic flux which couples via mutual inductance to the radiating member 41. It is to be appreciated that although the connection at 45 is, in the illustrated embodiment, a directly tapped galvanic connection, alternative embodiments do not require the inductive loop 45-43-47 to be in galvanic contact with the radiating member 41. The second input connection 46 is connected to the radiating element 41 via a capacitance which is created between the input probe 47 and a portion of the radiating element 48. The dimensions of the conductors 47 and 48 are chosen to optimize the input impedance presented at the connection points 45 and 46. In an exemplary practical embodiment of the invention the overall dimensions of the folded loop antenna are 50 mm×10 mm×3 mm. Input 45 provides for operation in the frequency band 698-798 MHz, while input 46 provides for operation in the frequency bands 826-890 MHz, 880-960 MHz, 1710-1880 MHz, 1850-1990 MHz and 1990-2170 MHz, encompassing international assignments for three major mobile radio protocols. FIG. 6 shows the underside of the laminar dielectric member 49 in the region of the dielectric antenna support 42. Capacitive connection 46 passes under the dielectric member 49 and couples capacitively with the conductor 48 on the topside of the dielectric member 49.

The large number of degrees of freedom provided by embodiments of the present invention enables the characteristics of an antenna to be varied over a very wide range and enable the multiband operation necessary in modern mobile radio devices.

Figure 7:
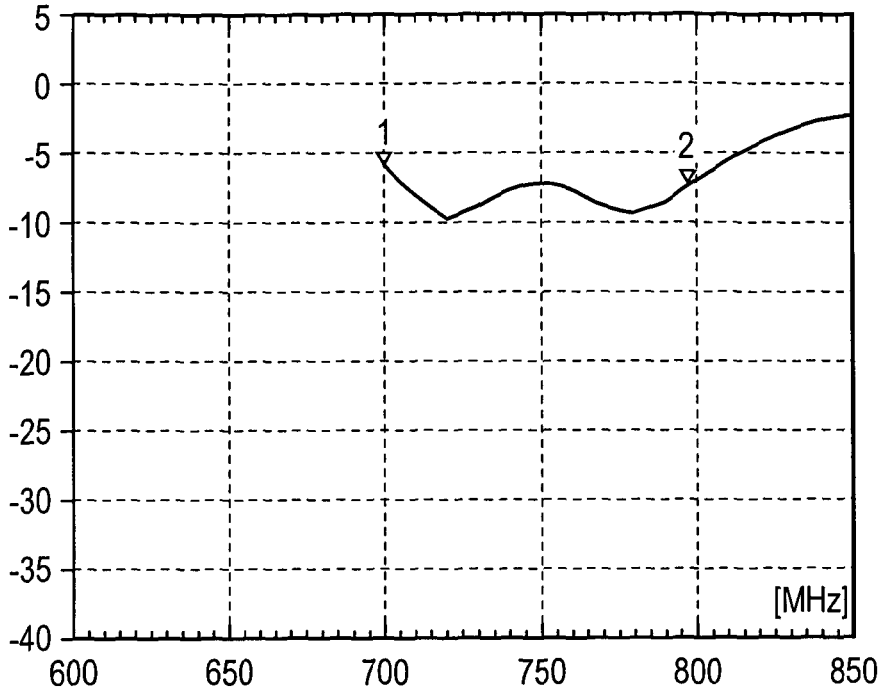
FIG. 7 is a plot of the measured return loss of the embodiment of FIGS. 5 and 6 for the 698-798 MHz band.
Figure 8:
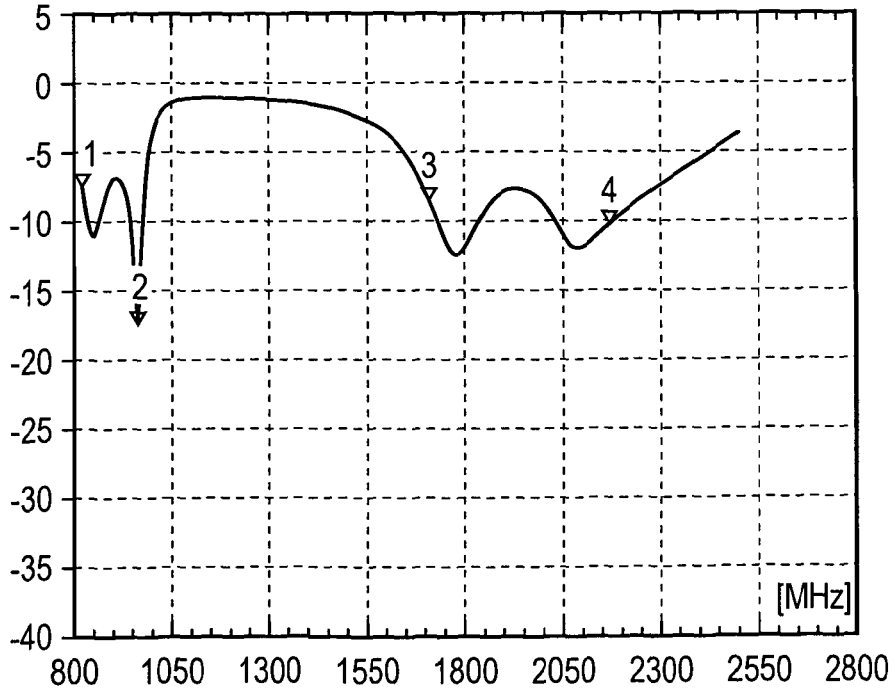
FIG. 8 is a plot of the measured return loss of the embodiment of FIGS. 5 and 6 between 800 MHz and 2500 MHz.

FIG. 7 shows the measured return loss of the embodiment of FIG. 5 at the input port for the 698-798 MHz band. FIG. 8 shows the measured return loss between around 800 MHz and 2500 MHz, showing that the antenna arrangement works effectively also in the 850 MHz, 900 MHz, 1800 MHz, 1900 MHz and 2100 MHz bands. In FIG. 8, the indicated points are as follows: 1) 824 MHz, 2) 960 MHz, 3) 1710 MHz and 4) 2170 MHz.

Figures 9A, 9B, 9C:
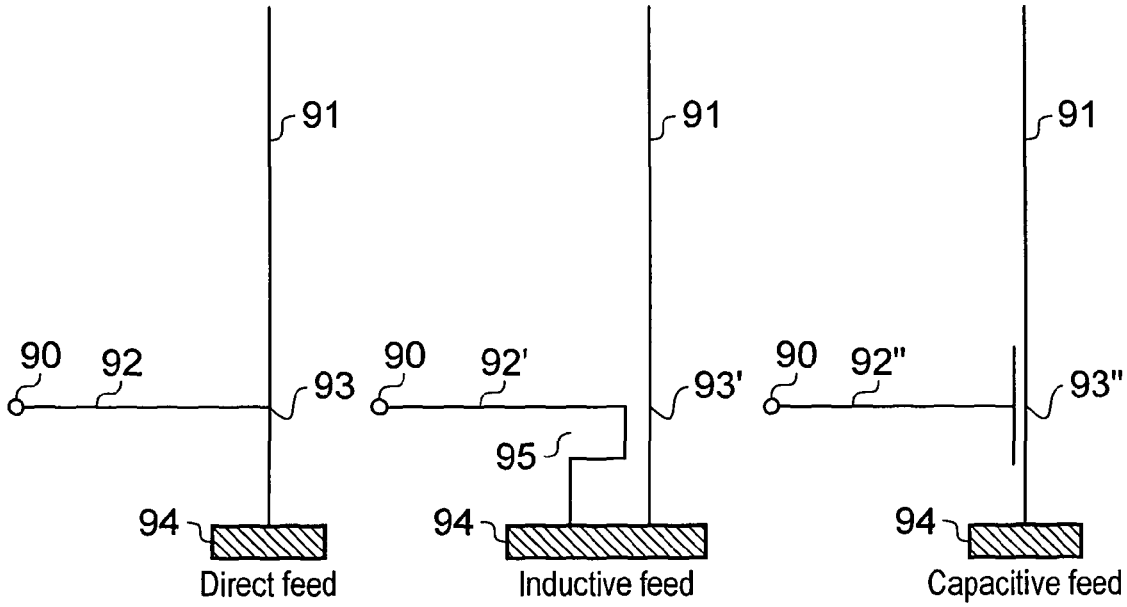
FIG. 9 compares three feed arrangements.

FIG. 9 shows, for illustrative purposes, a direct feed arrangement contrasted with inductive and capacitive feeds as used in embodiments of the present invention. In a direct feed (FIG. 9*a*), there is a direct electrical connection from input terminal 90 to a radiating element 91 by way of a conductive electrical pathway 92 connected to the radiating element at feed point 93. In this embodiment, one end of the radiating element 91 is connected to RF ground 94. FIG. 9*b* shows an inductive feed arrangement, where a loop 95 is formed in electrical pathway 92', and magnetic flux generated by the loop 95 couples inductively with the radiating element 91 at feed point 93'. One end of the electrical pathway 92' is connected to RF ground 94 in this embodiment. FIG. 9*c* shows a capacitive feed arrangement, where an electrical pathway 92" extends from the input terminal 90 and couples capacitively with the radiating element 91 at feed point 93".

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An antenna arrangement comprising an electrically conductive radiating element having first and second ends, an electrically conductive groundplane, and an input terminal; wherein the radiating element has a plurality of separate feed points at different locations between its first and second ends, and wherein each of the feed points is electrically connected to a switch by way of a separate electrical pathway, the switch being configured to selectively connect and disconnect each of the separate electrical pathways to and from the input terminal by selecting between a plurality of selectable contacts, and wherein at least one of the electrical pathways includes a capacitive circuit component connected in series with one of the feed points and wherein at least one other of the electrical pathways includes an inductive circuit component connected in series with another one of the feed points, wherein at least one inductive circuit component is connected in series with the radiating element between at least one pair of feed points.

2. The arrangement of claim 1, wherein there are two feed points.

3. An arrangement as claimed in claim 1, wherein there are at least three feed points.

4. The arrangement of claim 1, wherein the first end of the radiating element is electrically connected to the groundplane.

5. The arrangement as claimed in of claim 4, wherein the first end of the radiating element connected to the groundplane is by way of a capacitive and/or inductive circuit component.

6. The arrangement of claim 1, wherein at least one resistive circuit component is connected in series with the radiating element between at least one pair of feed points.

7. The arrangement of claim 1, wherein at least one capacitive circuit component is connected in series with the radiating element between at least one pair of feed points.

8. The arrangement of claim 1, wherein matching networks comprising inductive and/or capacitive circuit components are connected in series with the electrical pathways.

9. The arrangement of claim 8, wherein the matching networks include at least some circuit components connected to the groundplane.

10. The arrangement of claim 1, wherein the radiating element takes the form of a loop antenna comprising a dielectric substrate having first and second surfaces opposite to each other and a conductive track formed on the dielectric substrate, wherein there is provided a first feed point, a second feed point and a grounding point on the first surface of the substrate, with the conductive track extending from the first feed point and the grounding point respectively, then extending towards an edge of the dielectric substrate, then passing to the second surface of the dielectric substrate and then passing across the second surface of the dielectric substrate along a path generally following the path taken on the first surface of the dielectric substrate, before connecting at a conductive loading plate formed on the second surface of the dielectric substrate that extends into a central part of a loop formed by the conductive track on the second surface of the dielectric substrate.

11. The arrangement of claim 10, wherein the first feed point is configured as an inductive feed and the second feed point is configured as a capacitive feed.

* * * * *